US007252360B2

(12) United States Patent
Hersch et al.

(10) Patent No.: US 7,252,360 B2
(45) Date of Patent: Aug. 7, 2007

(54) INK THICKNESS VARIATIONS FOR THE CONTROL OF COLOR PRINTERS

(75) Inventors: Roger D. Hersch, Epalinges (CH); Peter Amrhyn, Ruswil (CH); Matthias Riepenhoff, Bern (CH)

(73) Assignee: Ecole polytechnique fédérale de Lausanne (EPFL), Lausanne (CH)

( * ) Notice: Subject to any disclaimer, the term of this patent is extended or adjusted under 35 U.S.C. 154(b) by 113 days.

(21) Appl. No.: 11/256,850

(22) Filed: Oct. 25, 2005

(65) Prior Publication Data

US 2007/0091138 A1 Apr. 26, 2007

(51) Int. Cl.
*B41J 29/393* (2006.01)

(52) U.S. Cl. ..... 347/19; 347/15

(58) Field of Classification Search ..... 347/19, 347/15

See application file for complete search history.

(56) References Cited

U.S. PATENT DOCUMENTS

| | | | | |
|---|---|---|---|---|
| 4,685,139 | A | 8/1987 | Masuda et al. | |
| 4,852,485 | A | 8/1989 | Brunner | |
| 5,357,448 | A * | 10/1994 | Stanford | 382/112 |
| 6,230,622 | B1 | 5/2001 | Dilling | |
| 6,314,263 | B1 * | 11/2001 | Yoshida et al. | 399/286 |
| 7,017,492 | B2 * | 3/2006 | Seymour | 101/484 |

OTHER PUBLICATIONS

U.S. Appl. No. 10/631,743, filed Aug. 1, 2003, R. D. Hersch, P. Emmel, F. Collaud Prediction model for color separation, calibration and control of printers.

U.S. Appl. No. 10/698,667, filed Oct. 31, 2003, Staelin et al. Inks Thickness Consistency in Digital Printing Presses.

U.S. Appl. No. 10/186,590, filed Jul. 1, 2002, Riepenhoff Measurement and regulation of inking in web printing.

F.R. Clapper, J.A.C Yule, "The effect of multiple internal reflections on the densities of halftone prints on paper", Journal of the Optical Society of America, vol. 43, 1953, 600-603.

(Continued)

*Primary Examiner*—Thinh Nguyen

(57) ABSTRACT

The present invention proposes a method and a computing system for deducing ink thickness variations from spectral reflectance measurements performed on a printing press or on a printer. The computed ink thickness variations enable controlling the ink deposition and therefore the color accuracy, both in the case of high-speed printing presses and of network printers. Ink thickness variations are expressed as ink thickness variation factors incorporated into a spectral prediction model. The method for computing ink thickness variations comprises both calibration and ink thickness variation computation steps. The calibration steps comprise the calculation of ink transmittances from measured reflectances and the computation of possibly wavelength-dependent ink thicknesses of solid superposed inks. Wavelength-dependent ink thicknesses account for the scattering behavior of non-transparent inks or of inks partly entering into the paper bulk. The ink thickness variation factors are fitted by minimizing a distance metric between the reflection spectrum predicted according to the thickness variation enhanced spectral prediction model and the measured reflection spectrum. The ink thickness variation enhanced spectral prediction model can be applied both in the visible wavelength range and in the near-infrared wavelength range. This enables computing unambiguously the thickness variations of the cyan, magenta, yellow and black inks. Furthermore, a spectral reflection may be measured over a stripe of a printed page and used to predict the ink thickness variations occurring within that stripe. This enables the real-time control of the ink deposition process on a printing press.

19 Claims, 7 Drawing Sheets

OTHER PUBLICATIONS

R.D. Hersch, et. al., "Spectral reflection and dot surface prediction models for color halftone prints", Journal of Electronic Imaging, vol. 14, No. 3, Aug. 2005, pp. 33001-33012.

R.D. Hersch, et. al., Spectral prediction and dot surface estimation models for halftone prints, SPIE vol. 5293, Jan. 2004, pp. 356-369.

R.D Hersch and al, "Improving the Yule-Nielsen modified spectral Neugebauer model by dot surface coverages depending on the ink superposition conditions", IS&T/SPIE Electronic Imaging Symposium, Conf. Imaging X: Processing, Hardcopy and Applications, Jan. 2005, SPIE vol. 5667, pp. 434-445.

H. Kipphan, Handbook of Print Media, Springer-Verlag, 2001, pp. 103-105.

G. Rogers, "A Generalized Clapper-Yule Model of Halftone Reflectance", Journal of Color Research and Application, vol. 25, No. 6, pp. 402-407 (2000).

* cited by examiner

INK THICKNESS VARIATIONS FOR THE CONTROL OF COLOR PRINTERS

BACKGROUND OF THE INVENTION

The present invention relates to the field of color printing and more specifically to the control of color printer actuation parameters. It discloses a computation model, computing systems and methods for computing ink thickness variations of color prints being generally printed with cyan, magenta, yellow and black inks. It represents an improvement over an initial model previously disclosed by one of the present inventors (see U.S. patent application Ser. No. 10/631,743, "Prediction model for color separation, calibration and control of printers", filed Aug. 1, 2003, inventors R. D. Hersch, P. Emmel, F. Collaud).

Color control in printing presses is desirable in order to ensure that effectively printed colors correspond to the desired colors, i.e. the colors expected by the prepress color separation stage. Color consistency is desirable both across consecutive pages of a multi-page print job and also from print job to print job.

In the prior art, densitometers are often used to control the amount of ink of single ink printed patches. The densitometer measures the optical density, which is an approximate measure of the ink thickness. In the prior art, the control of printer actuation parameters affecting the printed output such as the ink thickness is generally performed by an operator or by an apparatus measuring the density of solid ink or of halftone ink patches, see U.S. Pat. 4,852,485 (Method of operating an autotypical color offset machine, Inventor F. Brunner, issued Aug. 1, 1989). Special patches are usually integrated along the borders of printed pages and serve as a means to measure their density. These special patches need however to be subsequently cut out.

Patent U.S. Pat. No. 4,685,139 (Inspecting device for print, to Masuda et. al, issued Aug. 4, 1987) teaches how to detect a print defect by comparing RGB sensor values acquired along a horizontal stripe perpendicular to the cylinder rotation orientation and pre-stored RGB sensor values. In the case that a defect is detected, an operator is called to take care of it.

U.S. Pat. No. 6,230,622 (Image data-oriented printing machine and method of operating the same, to P. Dilling, issued May 15 2001) teaches a method for operating a printing machine with an expert system which determines the effect of the interaction of a large number of print parameters and acts on some of these parameters in order to reach a high print quality. The proposed method relies only density measurements. Due to the large number of parameters which need to be taken into account, this solution seems very complex and costly.

U.S. patent application Ser. No. 10/631,743 (Prediction model for color separation, calibration and control of printers, inventors R. D. Hersch (also co-inventor in the present patent application), P. Emmel, F. Collaud, filed Aug. 1, 2003) teaches a method to deduce the ink thicknesses for a color patch printed with 2, 3 or 4 inks. The method works for deducing the ink thicknesses on single ink patches, on two ink patches and possibly on 3 ink patches. But due to the uncertainty between joint variations in the ink thicknesses of cyan, magenta and yellow and a variation in thickness of black, the method does not work well for the set of cyan, magenta, yellow and black inks. In addition, since spectral measurements are performed on specific chromatic halftone elements within a printed page, the method does not easily allow performing real-time control of ink thicknesses on high-speed printing presses. Finally, the proposed way of computing scalar ink thicknesses assumes that the inks do not scatter back light, i.e. that they do not penetrate into the paper bulk.

U.S. patent application Ser. No. 10/698,667 (Inks Thickness Consistency in Digital Printing Presses, to Staelin et al., filed Oct. 31, 2003) teaches a model for estimating ink thickness control parameters such as the developer voltage in case of an electrographic printer. This model takes as input values the densities of monochrome patches. This patent application does neither teach how to obtain ink thickness control parameters from polychromatic halftone patches nor from halftones being part of the actual printed pages.

U.S. patent application Ser. No. 10/186,590 (Measurement and regulation of inking in web printing, to Riepenhoff, also co-inventor of the present application, filed 1Jul. 2002) teaches a process for measuring the mean spectrum integrated over a stripe of the printed page. It also teaches a device for regulating the ink density by predicting the mean reflection spectrum along a stripe thanks to a correspondence function between image data located along the stripe and the resulting reflection spectrum. However, that correspondence function does not incorporate an explicit ink thickness variable, nor does it make the distinction between nominal surface coverages and effective surface coverages. It therefore does not account for the ink spreading phenomenon. Finally, that application does not teach how to take into account the uncertainty between joint variations in the densities of the cyan, magenta and yellow inks, and a variation in the density of the black ink.

The present disclosure solves the above mentioned problems and provides a stable means of deducing in real time ink thickness variations of cyan, magenta, yellow and black on a running printing press or printer, without needing special solid or halftone patches within the printed page.

SUMMARY

The present invention proposes a method and a computing system for deducing ink thickness variations from spectral reflectance measurements performed on a printing press or on a printer. Both the spectral reflectance measurements and the computation of the ink thickness variations may be performed on-line and in real-time, therefore allowing the regulation of the ink deposition process, for example in the case of an offset press, the ink feed and the damper agent feed. Real-time on-line control of the ink deposition process enables keeping a high color accuracy from print page to print page and from print job to print job. It also enables, in most cases, to avoid the time-consuming setup of print parameters by a skilled print operator.

Ink thickness variations are expressed as ink thickness variation factors incorporated into a spectral prediction model. The spectral prediction model enhanced with ink thicknesses is a "thickness enhanced spectral prediction model" and further enhanced with ink thickness variation factors is a "thickness variation enhanced spectral prediction model".

The method for computing ink thickness variations comprises both calibration and ink thickness variation computation steps. The calibration steps comprise the calculation of ink transmittances from measured reflectances, the computation of possibly wavelength-dependent ink thicknesses of solid superposed inks and possibly, in order to account for ink spreading, the computation of effective surface coverages of single ink halftones in all superposition conditions along with the derivation of effective surface coverage curves mapping nominal to effective surface coverages. Wavelength-dependent ink thicknesses account for the scattering behavior of non-transparent inks or of inks partly penetrating into the paper bulk. In respect to the ink thickness variation computation steps, the thickness variation enhanced spectral prediction model comprises as solid colorant transmittance of two or more superposed solid inks the transmittance of each of the contributing superposed ink raised to the power of a product of two variables, one variable being the superposition condition dependent ink thickness and the other variable being the ink thickness variation factor. The ink thickness variation factors are fitted by minimizing a distance metric between the reflection spectrum predicted according to the thickness variation enhanced spectral prediction model and the measured reflection spectrum.

It is a further objective of the present disclosure to resolve the uncertainty in respect to joint thickness variations of cyan, magenta and yellow, and a thickness variation of black by applying the ink thickness variation enhanced spectral prediction model not only in the visible wavelength range, but also in the near-infrared wavelength range. This enables computing unambiguously the thickness variations of the cyan, magenta, yellow and black inks.

In order to perform reflection spectra acquisitions at print time, the spectral acquisition device is operable for measuring a mean reflection spectrum over a stripe of the printed page. The predicted stripe reflection spectrum is the reflection spectrum predicted from stripe mean effective surface coverages, which are obtained by averaging reflection spectra predicted over the small areas composing the stripe and by fitting from the resulting averaged reflection spectrum the stripe mean effective surface coverages, again by making use of the spectral prediction model. In the case of a stripe, ink thickness variations are computed by minimizing a distance metric between the measured stripe mean reflection spectrum and the predicted stripe reflection spectrum.

In case of non-optimal calibration conditions, thickness variation predictions may be improved by first recording reference thickness variations under optimal conditions and then by computing ink thickness variations normalized in respect to the reference ink thickness variations.

If the nominal surface coverages of the halftone or stripe on which thickness variations are to be performed are unknown, it is possible, in addition to the calibration of the transmittances and the thicknesses of the inks, to measure a reference reflection spectrum from a reference print under optimal settings and to deduce with the thickness enhanced spectral prediction model the corresponding reference effective surface coverages. The predicted reflection spectrum is then predicted with the deduced reference effective surface coverages. Ink thickness variations are again computed by minimizing a distance metric between predicted reflection spectrum and measured reflection spectrum. The computed ink thickness variations represent ink thickness variations in respect to the reference print.

DETAILED DESCRIPTION OF THE INVENTION

Figure 1:
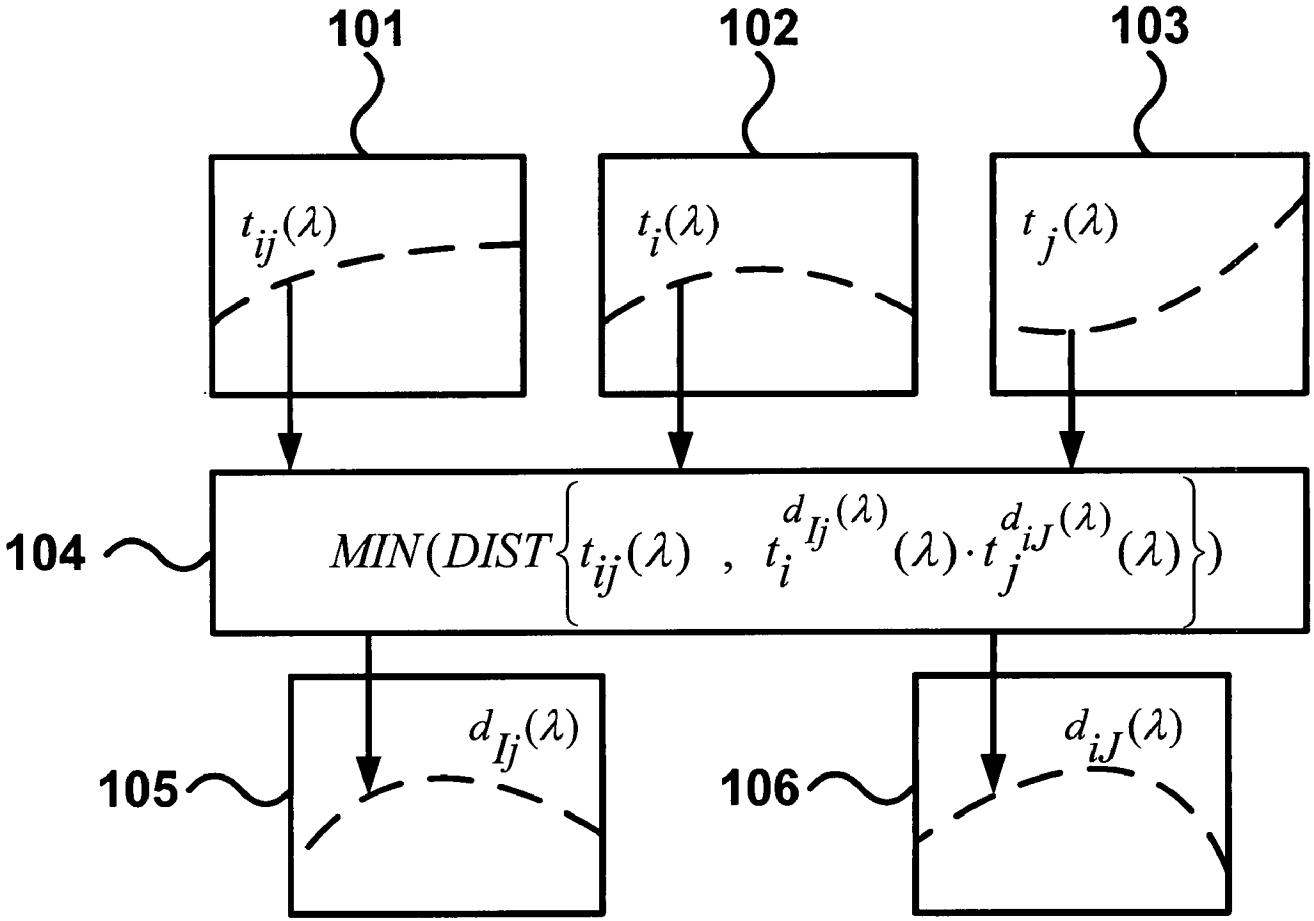
FIG. 1 shows a schematic view of the computation of initial wavelength-dependent thicknesses of the contributing inks for a solid colorant made of two superposed solid inks.

The present invention proposes models, a computing systems as well as methods for deducing ink thickness variations from spectral measurements carried out on a printer or printing press, possibly on-line and in real-time. The computed ink thickness variations enable controlling the ink deposition and therefore the color accuracy, both in the case of high-speed printing presses and of network printers. The ink thickness variations can be directly used for the real-time control of the print actuation parameters which influence the ink deposition, such as the ink feed and/or the damping agent feed in the case of an offset press.

The proposed method and computing system rely on a spectral prediction model explicitly incorporating as parameters the ink thicknesses and the ink thickness variations. Hereinafter, such a model is called "thickness variation enhanced spectral prediction model". When this model is used for computing ink thickness variations, it may also be called "ink thickness variation computation model". The two model denominations are used interchangeably. When the ink thickness variation computation model is embodied by a computing system, it becomes an "ink thickness variation computing module". In the case where no ink thickness variations are considered, for example for calibration and initialization purposes, the "ink thickness variation enhanced spectral prediction model" is more precisely called "ink thickness enhanced spectral prediction model".

In the present invention, unknown variables are often fitted by minimizing a distance metric between a measured reflection spectrum and a reflection spectrum predicted according to a spectral reflectance prediction model. The preferred distance metric is the sum of square differences between the corresponding measured and predicted reflection density spectra, with reflection density spectra being computed from reflection spectra according to formula (2). But other distance metrics which also give more weight to the lower reflectance values of the reflectance spectra are also appropriate, for example a spectral reflection "exponential" function $Z(\lambda)=e^{-3*R(\lambda)}$, with $R(\lambda)$ being the spectral reflectance. In this case, the distance metric would be the sum of square differences between the corresponding measured and predicted reflection exponential spectra. Minimizing a distance metric can be carried out, for example with a matrix manipulation software package such as Matlab or with a program implementing Powell's function minimization method (see W. H. Press, B. P. Flannery, S. A. Teukolsky, W. T. Fetterling, Numerical Recipes, Cambridge University Press, 1st edition, 1988, section 10.5, pp. 309-317).

Once printed, the physical size of the printed dot generally increases, partly due to the interaction between the ink and the paper, and partly due to the interaction between successively printed ink layers. This phenomenon is called physical (or mechanical) dot gain or ink spreading. Therefore, "nominal surface coverages" (or simply "nominal coverages") are initially specified amounts of inks and "fitted surface coverages" (or simply "fitted coverages") are effective (i.e. physical) surface coverages inferred from the spectral measurements of the printed patches according to the applied spectral prediction model.

Patches which are printed with multiple, superposed inks are called polychromatic patches. A solid ink patch is a patch printed with 100% coverage. A halftone patch is a patch where at least one ink layer is printed in halftone. A calibration halftone patch is a patch where one ink is printed as a halftone at a specified nominal surface coverage value, for example 25%, 50% or 75%. In a calibration halftone patch, only one ink is a halftone. This halftone may be printed alone on paper or printed in superposition with other solid inks.

The considered inks are usually the standard cyan, magenta, yellow and black inks. But the disclosed ink thickness variation computation model may also be applied in straightforward manner to inks of other colors. For example, the set of inks may comprise the standard cyan, magenta and yellow inks plus one or several additional inks such as orange, red, green and blue. The term "ink" is used in a generic sense: it may comprise any colored matter that can be transferred onto specific locations of a substrate (e.g. offset inks, ink-jet inks, toner particles, liquid toner, dye sublimation colorants, etc . . . ).

Throughout the application the expressions "printer" and "printing press" are used interchangeably, i.e. the disclosure with respect to one is equally applicable with respect to the other. The invention is advantageous, in particular, for computing ink thickness variations and ink thickness variation computing systems for controlling the color quality in a rotary printing press, notably in a web-fed printing press. Offset printing, i.e. wet or dry offset printing, is a preferred printing process. A primary field of application is newspaper printing.

Another field of application is the control of the ink deposition in printers connected to networks, such as electrographic printers, ink-jet printers, liquid-toner printers, dye sublimation printers and thermal transfer printers.

The present invention aims at controlling printer actuation parameters such as ink feed by deducing the thickness variations of the inks from the spectral reflectance of halftones or halftone stripes. This goal can be reached thanks to an accurate spectral reflectance prediction model which has an explicit representation of the ink transmittances, of ink thicknesses, of ink thickness variations and which takes into account ink spreading, i.e. the mapping from nominal to effective dot surface coverages under different ink superposition conditions. The disclosed ink thickness variation computation model comprises all these parts. The embodiment of the disclosed ink thickness variation computation model presented here relies on the Clapper-Yule spectral reflection prediction model.

The Clapper-Yule model (see F. R. Clapper, J. A. C Yule, "The effect of multiple internal reflections on the densities of halftone prints on paper", Journal of the Optical Society of America, Vol. 43, 1953, 600-603, hereinafter referenced as [Clapper53]), takes simultaneously into account halftone patterns and multiple internal reflections occurring at the interface between the paper and the air and assumes a relatively high screen frequency. However other spectral prediction models exist which do not make this assumption and may also be used for predicting ink thickness variations on non high frequency screen prints, see (a) G. Rogers, "A Generalized Clapper-Yule Model of Halftone Reflectance", Journal of Color Research and Application, Vol. 25, No. 6, 402-407 (2000), (b) R. D. Hersch and al, "Spectral reflection and dot surface prediction models for color halftone prints", R. D. Hersch, et. al., Journal of Electronic Imaging, Vol. 14, No. 3, August 2005, pp. 33001-12, incorporated in the present disclosure by reference, hereinafter referenced as [Hersch05A], (published also in reduced form in R. D. Hersch et. al., "Spectral prediction and dot surface estimation models for halftone prints", SPIE Vol. 5293, January 04, 356-369) and R. D Hersch and al, "Improving the Yule-Nielsen modified spectral Neugebauer model by dot surface coverages depending on the ink superposition conditions", IS&T/SPIE Electronic Imaging Symposium, Conf. Imaging X: Processing, Hardcopy and Applications, January 05, SPIE Vol. 5667, 434-445, hereinafter referenced as [Hersch05B].

For four ink prints, the Clapper-Yule spectral reflection prediction model may be formulated as follows;

$$R(\lambda) = K * r_s + \frac{(1 - r_s) * r_g(\lambda) * (1 - r_i) * (\sum_{j=1}^{16} a_j * t_j(\lambda)^2}{1 - r_g(\lambda) * r_i * \sum_{j=1}^{16} a_j * t_j^2(\lambda)} \quad (1)$$

where K is the fraction of specular reflected light reaching the spectrophotometer (for a 45/0 degrees measuring geometry, K=0), $r_s$ is the surface reflection at the air paper coating interface, $r_g$ is the paper substrate reflectance, $r_i$ is the internal Fresnel reflection factor obtained by integrating the Fresnel reflection factor over all orientations, $a_j$ represents the fractional surface coverage of a colorant, $t_j$ represents the transmittance of a colorant and $R(\lambda)$ is the predicted reflection spectrum.

The corresponding reflection density spectrum is given by the following well known formula $$D(\lambda) = -\log_{10}(R(\lambda)) \quad (2)$$

Equations (1) and (2) define the Clapper-Yule spectral prediction model, where either the reflection spectrum is predicted or the reflection density spectrum is predicted.

In the case of paper printed with for example the 4 inks cyan ($c_c$ or $c_1$), magenta ($c_m$ or $c_2$), yellow ($c_y$ or $c_3$), and black ($c_k$ or $c_4$), the surface coverages of the resulting 16 solid colorants are obtained according to the Demichel equations (see [Hersch05A]). In that case, the colorant surface coverages are cyan only $a_1$(or $a_c$), magenta only $a_2$ (or $a_m$), yellow only $a_3$ (or $a_y$), black only $a_4$ (or $a_k$), blue (cyan+magenta) $a_5$ (or $a_{cm}$), green (cyan+yellow) $a_6$ (or $a_{cy}$), cyan+black $a_7$ (or $a_{ck}$), red (magenta+yellow) $a_8$ (or $a_{my}$), magenta+black $a_9$ (or $a_{mk}$), yellow+black $a_{10}$ (or $a_{yk}$), colored black (cyan+magenta+yellow) $a_{11}$ (or $a_{cmy}$), magenta+yellow+black $a_{12}$ (or $a_{myk}$), cyan+yellow+black $a_{13}$ (or $a_{cyk}$), cyan+magenta+black $a_{14}$ (or $a_{cmk}$), cyan+magenta+yellow+black $a_{15}$ (or $a_{cmyk}$) and paper white (no ink) $a_{16}$ (or $a_w$). The Demichel equations (3) yield the colorant surface coverages $a_i$ as a function of the ink surface coverages $c_1$, $c_2$, $c_3$, and $c_4$ of the inks $i_1$, $i_2$, $i_3$, and $i_4$.

Equations (3):

$$i_1 \text{ alone: } a_1 = c_1(1-c_2)(1-c_3)(1-c_4)$$

$$i_2 \text{ alone: } a_2 = (1-c_1)c_2(1-c_3)(1-c_4)$$

$i_3$ alone $a_3=(1-c_1)(1-c_2)c_3(1-c_4)$ $i_4$ alone: $a_4=(1-c_1)(1-c_2)(1-c_3)c_4$ $i_1$ and $i_2$: $a_5=c_1c_2(1-c_3)(1-c_4)$ $i_1$ and $i_3$: $a_6=c_1(1-c_2)c_3(1-c_4)$ $i_1$ and $i_4$: $a_7=c_1(1-c_2)(1-c_3)c_4$ $i_2$ and $i_3$: $a_8=(1-c_1)c_2c_3(1-c_4)$ $i_2$ and $i_4$: $a_9=(1-c_1)c_2(1-c_3)c_4$ $i_3$ and $i_4$: $a_{10}=(1-c_1)(1-c_2)c_3c_4$ $i_1$, $i_2$ and $i_3$: $a_{11}=c_1c_2c_3(1-c_4)$ $i_2$, $i_3$ and $i_4$: $a_{12}=(1-c_1)c_2c_3c_4$ $i_i$, $i_3$ and $i_4$: $a_{13}=c_1(1-c_2)c_3c_4$ $i_i$, $i_2$ and $i_4$: $a_{14}=c_1c_2(1-c_3)c_4$ $i_1$, $i_2$, $i_3$ and $i_4$: $a_{15}=c_1c_2c_3c_4$ white: $a_{16}=(1-c_1)(1-c_2)(1-c_3)(1-c_4)$.

By inserting the relative amounts of colorants $a_i$ and their transmittances $t_i$ into Equation (1), we obtain a predicted reflection spectrum of a color patch printed with given surface coverages of cyan, magenta, yellow and black. Both the specular reflection $r_s$ and the internal reflection $r_i$ depend on the refraction indices of the air ($n_1=1$) and of the paper ($n_2=1.5$ for paper). According to the Fresnel equations (see E. Hecht, Schaum's Outline of Optics, McGraw-Hill, 1974, Chapter 3), for collimated light at an incident angle of 45°, the specular reflection factor is $r_s=0.05$. With light diffusely reflected by the paper (Lambert radiator), the internal reflection factor is $r_i=0.6$ (see D. B. Judd, Fresnel reflection of diffusely incident light, Journal of Research of the National Bureau of Standards, Vol. 29, November 42, 329-332).

To put the model into practice, we deduce from Equation (1) the internal reflectance spectrum $r_g$ of a blank paper by setting all the ink surface coverages different from white as zero $$r_g = \frac{R_w - K * r_s}{1 + (1-K) * r_j * r_s + r_i * R_w - r_s - r_i} \tag{4}$$

where $R_w$ is the measured unprinted paper reflectance.

We then calculate the transmittance of each individual solid colorant (solid inks and solid ink superposition) $t_c$, $t_m$, $t_y$, $t_k$, $t_{cm}$, $t_{cy}$, $t_{ck}$, $t_{my}$, $t_{mk}$, $t_{yk}$ , $t_{cmy}$, $t_{myk}$, $t_{cyk}$, $t_{cmk}$, $t_{cmyk}$, $t_w$ by inserting into Eq. (1) the measured solid colorant reflectance $R_i$ and by setting the appropriate colorant surface coverage $a_i=1$ and all other colorant coverages $a_{j\neq i}=0$. The transmittance of solid colorant i becomes $$t_i = \sqrt{\frac{R_i - K * r_s}{r_g * r_i * (R_i - K * r_s) + r_g * (1 - r_i) * (1 - r_s)}} \tag{5}$$

We must also take the ink spreading into account, i.e. the increase in effective (physical) dot surface coverage. For each ink u, we fit according to our spectral prediction model, i.e. the Clapper-Yule model [Eq. (1), with $a_{j=u}$ being fitted and $a_{j\neq u}=0$] the unknown physical coverages of the measured single ink patches at nominal coverages of e.g. 25%, 50%, 75%, 100% by minimizing a distance metric between predicted and measured reflection spectra, for example by minimizing the sum of square differences between the predicted reflection density spectra and the measured reflection density spectra. This minimization yields the effective surface coverages.

Similarly, we fit the unknown physical surface coverages of single ink halftones $a_u$ printed in superposition with a second ink at nominal surface coverages (e.g. at 25%, 50% and 75%) with the spectral prediction model [Eq. (1), with halftone surface coverage $a_u$ being fitted, a second solid ink $a_v=1$ and all other surface coverages $a_{(j\neq u, j\neq v)}=0$], by minimizing a distance metric between predicted and measured reflection spectra. The same procedure is applied for fitting the unknown physical surface coverages of single ink halftones $a_u$ printed in super-position with two solid inks [Eq. (1), with halftone surface coverage $a_{j=u}$ being fitted, a second solid ink $a_v=1$, a $3^{rd}$ solid ink $a_w=1$ and all other surface coverages $a_{(j\neq u, j\neq v, j\neq w)}=0$]. The same procedure is applied to fit the unknown physical surface coverages of single ink halftones $a_u$ printed in superposition with three solid inks [Eq. (1), with halftone surface coverage $a_{j=u}$ being fitted, a second solid ink $a_v=1$, a $3^{rd}$ solid ink $a_w=1$ and a $4^{th}$ solid ink $a_z=1$ and all other surface coverages $a_{(j\neq u, j\neq v, j\neq w, j\neq w)}=0$]. Each set of fitted halftone ink patches (halftone printed with ink u, noted $u_h$, possibly superposed with solid inks v, w and z) maps nominal surface coverages to effective surface coverages for that superposition condition $\{u_h, v, w, z\}$. By interpolating between the known mappings between nominal to effective surface coverages, one obtains for each superposition condition a function mapping between nominal to effective surface coverages. This function is called "effective surface coverage curve" or "effective coverage curve".

In order to obtain the effective surface coverages $c_1$, $c_2$, $c_3$ and $c_4$ of a color halftone patch from their nominal coverages $c_{1n}$, $c_{2n}$ $c_{3n}$, and $c_{4n}$ and then, with the Demichel equations (3) to obtain the corresponding effective colorant surface coverages $a_j$ to be inserted in the spectral prediction model equation (1), it is necessary to weight the contributions of the corresponding effective coverage curves. The weighting functions depend on the effective coverages of the considered ink alone, of the considered ink in superposition with a second ink, of the considered ink in superposition with the two other inks and of the considered ink in superposition with the three other inks. For the considered system of 4 inks $i_1$, $i_2$, $i_3$ and $i_4$ with nominal coverages $c_{1n}$ $c_{2n}$, $c_{3n}$ and $c_{4n}$ and effective coverages $c_1$, $c_2$, $c_3$ and $c_4$, assuming that inks are printed independently of each other, e.g. according to the classical screen angles 15°, 45°, 75° and 0°, by computing the relative weight, i.e. the relative surface of each superposition condition, we obtain the system of equations (6). The proportion (relative effective surface) of a halftone patch printed with ink $i_1$ of coverage $c_1$ on paper white is $(1-c_2)(1-c_3)(1-c_4)$. The proportion of the same patch printed on top of solid ink $i_2$ is $c_2(1-c_3)(1-c_4)$, on top of solid ink $i_3$ is $(1-c_2)c_3(1-c_4)$, and on top of solid ink $i_4$ is $(1-c_2)(1-c_3)c_4$. The proportion of the same patch printed on top of solid inks $i_2$ and $i_3$ is $c_2c_3(1-c_4)$, on top of solid inks $i_2$ and $i_4$ is $c_2(1-c_3)c_4$, and on top of solid inks $i_3$ and $i_4$ is $(1-c_2)c_3c_4$. Finally the proportion of the halftone patch printed with ink $i_1$ of coverage $c_1$ on top of solid inks $i_2$, $i_3$ and $i_4$ is $c_2$ $c_3$ $C_4$. Similar considerations apply for halftone patches printed with inks $i_2$, $i_3$, $i_2$ and $i_4$. We obtain the system of equations (6), published in

[Hersch05A] and also to some extent described in U.S. patent application Ser. No. 10/631,743, "Prediction model for color separation, calibration and control of printers", filed Aug. 1, 2003, inventors R. D. Hersch, P. Emmel, F. Collaud.

Equation (6):

$$
\begin{aligned}
c_1 = {} & f_1(c_{1n})(1-c_2)(1-c_3)(1-c_4) + \\
& f_{21}(c_{1n})c_2(1-c_3)(1-c_4) + f_{31}(c_{1n})(1-c_2)c_3(1-c_4) + \\
& f_{41}(c_{1n})(1-c_2)(1-c_3)c_4 + f_{231}(c_{1n})c_2c_3(1-c_4) + \\
& f_{241}(c_{1n})c_2(1-c_3)c_4 + f_{341}(c_{1n})(1-c_2)c_3c_4 + f_{2341}(c_{1n})c_2c_3c_4 \\
c_2 = {} & f_2(c_{2n})(1-c_1)(1-c_3)(1-c_4) + f_{12}(c_{2n})c_1(1-c_3)(1-c_4) + \\
& f_{32}(c_{2n})(1-c_1)c_3(1-c_4) + f_{42}(c_{2n})(1-c_1)(1-c_3)c_4 + \\
& f_{132}(c_{2n})c_1c_3(1-c_4) + f_{142}(c_{2n})c_1(1-c_3)c_4 + \\
& f_{342}(c_{2n})(1-c_1)c_3c_4 + f_{1342}(c_{2n})c_1c_3c_4 \\
c_3 = {} & f_3(c_{3n})(1-c_1)(1-c_2)(1-c_4) + f_{13}(c_{3n})c_1(1-c_2)(1-c_4) + \\
& f_{23}(c_{3n})(1-c_1)c_2(1-c_4) + \\
& f_{43}(c_{3n})(1-c_1)(1-c_2)c_4 + \\
& f_{123}(c_{3n})c_1c_2(1-c_4) + \\
& f_{143}(c_{3n})c_1(1-c_2)c_4 + \\
& f_{243}(c_{3n})(1-c_1)c_2c_4 + f_{1243}(c_{3n})c_1c_2c_4 \\
c_4 = {} & f_4(c_{4n})(1-c_1)(1-c_2)(1-c_3) + f_{14}(c_{4n})c_1(1-c_2)(1-c_3) + \\
& f_{24}(c_{4n})(1-c_1)c_2(1-c_3) + \\
& f_{34}(c_{4n})(1-c_1)(1-c_2)c_3 + \\
& f_{124}(c_{4n})c_1c_2(1-c_3) + \\
& f_{134}(c_{4n})c_1(1-c_2)c_3 + \\
& f_{234}(c_{4n})(1-c_1)c_2c_3 + f_{1234}(c_{4n})c_1c_2c_3
\end{aligned}
$$

This system of equations can be solved by first assigning the nominal surface coverages $c_{1n}$ $c_{2n}$, $c_{3n}$ and $c_{4n}$ to the corresponding effective surface coverages $c_1$, $c_2$, $c_3$ and $c_4$ and then by performing several iterations, typically 5 iterations, until the system converges.

Wavelength-Dependent Initial Thicknesses

In this section, we disclose the first part of the ink thickness variation computation model. The computation of ink thickness variations requires an explicit expression of ink transmittances. Transmittances may be deduced from measured reflectances with any accurate spectral prediction model, in which the ink transmittances are explicitly expressed. In the present disclosure we rely on the Clapper-Yule reflection prediction model. However, the extended Clapper-Yule spectral prediction model presented in [Hersch05A] could have been used instead. Equally well, the Yule-Nielsen Spectral Neugebauer reflection spectra prediction model extended with effective coverages in all superposition conditions [Hersch05B], where reflection spectra of the inks $R_i$ are replaced by transmittance spectra $$R_i = t_i^{2} * \rho. \tag{7}$$

with $t_i$ expressing the transmittance of an ink and $\rho$ the unprinted paper reflectance, could have been used.

In most printing processes, there is a trapping effect. When several inks are printed on top of one another, the ink layers have a reduced ink thickness (see H. Kipphan, Handbook of Print Media, Springer-Verlag, 2001, pp. 103-105). The disclosed ink thickness variation computation model takes care of trapping by computing the internal transmittances $t_{ij}$ of colorants obtained by the superposition of two inks (e.g. cyan+magenta=blue, cyan+yellow=green, magenta+yellow=red, cyan+black, . . . ), of three inks $t_{ijk}$ (e.g. cyan+magenta+yellow=colored black, cyan+magenta+black, magenta-yellow-black, . . . ) and of four inks $t_{ijkl}$ (e.g. cyan-magenta-yellow-black) from the internal transmittance of the individual inks $t_c$, $t_m$, $t_y$, $t_k$ and from their respective fitted reduced thicknesses.

The ink transmittance describes the absorption of light traversing an ink layer. In case of two superposed inks, the light absorbed by the two ink layers depends on the transmittances of both inks. Since ink layers act as filters, we multiply their transmittances to describe the transmittance of two, three, or four ink layer superpositions. For each combination of solid inks (also called ink superposition condition), we compute their respective thicknesses, called "initial thicknesses".

In uncoated papers and even in some coated papers, the inks partly penetrate into the paper bulk. Part of the light is therefore scattered back before having traversed the full ink layer. Therefore, the inks can not always be considered as completely transparent. Since the back-scattered light does not fully penetrate the ink layer, the ink layer appears to have a reduced thickness. This reduced thickness depends on the ink reflection spectrum is therefore wavelength dependent. These apparent wavelength dependent thicknesses, called "wavelength dependent initial thicknesses" are incorporated into the spectral prediction model.

For each solid ink contributing to a superposition of solid inks, called "solid colorant", each solid ink wavelength-dependent spectral transmittance has a possibly wavelength-dependent initial thickness (also called "thickness vector"). Since we perform computations with relative thickness values, the initial thickness of a single ink is one. For two superposed inks i and j, two initial thickness vectors $d_{Ii}(\lambda)$ and $d_{iJ}(\lambda)$ for the inks i and j respectively are fitted, by starting from a thickness vector comprising only "1" components. The same applies for 3 inks or for 4 inks. In Eqs. (8) below, for example, the initial thickness $d_{iJk}(\lambda)$ expresses the initial thickness of ink j, when superposed with inks i and k. The initial thickness $d_{ijK}(\lambda)$ expresses thee initial thickness of ink k, when superposed with inks i and j. Similar denominations apply for the other initial thicknesses.

Equations (8):

$$t(\lambda)_{ij} = \hat{t}_i(\lambda)^{d_{Ij}(\lambda)} * y\hat{t}_j(\lambda)^{d_{iJ}(\lambda)}$$

$$t(\lambda)_{ijk} = \hat{t}_i(\lambda)^{d_{Ijk}(\lambda)} * \hat{t}_j(\lambda)^{d_{iJk}(\lambda)} * \hat{t}_k(\lambda)^{d_{ijK}(\lambda)}$$

$$t(\lambda)_{ijkl} = \hat{t}_i(\lambda)^{d_{Ijkl}(\lambda)} * \hat{t}_j(\lambda)^{d_{iJkl}(\lambda)} * \hat{t}_k(\lambda)^{d_{ijKl}(\lambda)} * \hat{t}_l(\lambda)^{d_{ijkL}(\lambda)}$$

where $\hat{t}_i(\lambda)$, $\hat{t}_j(\lambda)$, $\hat{t}_k(\lambda)$, $\hat{t}_l(\lambda)$ are respectively the initially computed wavelength-dependent transmittances of single solid inks i, j, k, l of the calibration patches, calculated according to Eq. (5). By inserting the colorant transmittances $t(\lambda)_{ij}$, $t(\lambda)_{ijk}$, $t(\lambda)_{ikIj}$ of Eqs. (8) for all ink superposition conditions into Eq. (1), the Clapper-Yule spectral prediction model becomes an "ink thickness enhanced spectral prediction model".

FIG. 1 shows an example of fitting the initial thicknesses for a superposition of two solid inks. In that case, three transmittances are needed: the transmittance of the superposed inks (solid colorant) 101 and the transmittances of each of the two individual inks 102 and 103. The calculations of the initial thicknesses are performed in 104 by starting with initial thicknesses of 1 and by minimizing a distance metric between the colorant transmittance and the product of the contributing ink transmittances raised to the power of their respective initial thicknesses. The distance metric may be the same as the one used for the spectral prediction model. The calculated initial thicknesses of inks i, $d_{Ij}$ (105), and of ink j, $d_{Ji}$ (106), are wavelength-dependent. Such an initial wavelength-dependent thickness is defined for each ink in each combination of solid inks, i.e. for each superposition condition or in other words, for each solid colorant comprising at least two inks. For example, for a printing system with 4 inks, initial thickness vectors are computed for each ink in all combinations of two, three and four ink superpositions.

Ink Thickness Variation Factors

Let us disclose the method allowing the computation of ink thickness variations. The introduction of ink thickness variation factors within the spectral prediction model [embodied by the Clapper-Yule model, Eq. (1)] allows the deduction of ink thickness variations from single patches or from a mean spectrum taken over a part of a printed page. We assume that the variation of the ink thickness of a particular ink is proportionally the same in all superposition conditions. We introduce the ink thickness variations into Eqs. (8) by multiplying each initial ink thickness (wavelength-dependent vector or wavelength-independent scalar value) with a scalar ink thickness variation factor (also simply called "ink thickness variation"). There is one ink thickness variation factor per contributing ink and it does not depend on the superposition condition, i.e. with which other ink (or inks) the considered ink is superposed. The transmittances of single ink, two ink, three ink and four ink solid colorants are expressed by ink transmittances and ink thicknesses [Eqs. (9)].

Equation (9):

$$t(\lambda)_i = \hat{t}_i(\lambda)^{dr_i}$$

$$t(\lambda)_{ij} = \hat{t}_i(\lambda)^{d_{Ij}(\lambda)*dr_i} * \hat{t}_j(\lambda)^{d_{iJ}(\lambda)dr_j}$$

$$t(\lambda)_{ijk} = \hat{t}_i(\lambda)^{d_{Ijk}(\lambda)*dr_i} * \hat{t}_j(\lambda)^{d_{iJk}(\lambda)*dr_j} * \hat{t}_k(\lambda)^{d_{ijK}(\lambda)*dr_k}$$

$$t(\lambda)_{ijkl} = \hat{t}_i(\lambda)^{d_{Ijkl}(\lambda)*dr_i} * \hat{t}_j(\lambda)^{d_{iJkl}(\lambda)*dr_j} * \hat{t}_k(\lambda)^{d_{ijKl}(\lambda)*dr_k} * \hat{t}_l(\lambda)^{d_{ijkL}(\lambda)*dr_l}$$

where the thickness variation factor of ink i is $dr_i$, of ink j is $dr_j$, of ink k is $dr_k$ and of ink l is $dr_l$.

In the case of cyan, magenta, yellow and black inks, we express the 16 colorant transmittances as follows.

Equations (10):

$t_C = \hat{t}_C^{drC}$; transmittance of solid colorant cyan $t_M = \hat{t}_M^{drM}$; transmittance of solid colorant magenta $t_Y = \hat{t}_Y^{drY}$; transmittance of solid colorant yellow $t_K = \hat{t}_K^{drK}$; transmittance of solid colorant black $t_{CM} = \hat{t}_C^{dCm*drC} * \hat{t}_M^{dcM*drM}$; transmittance of solid colorant cyan+magenta (blue)

$t_{CY} = \hat{t}_C^{dCm*drC} * \hat{t}_Y^{dcY*drY}$; transmittance of solid colorant cyan+yellow (green)

$t_{CK} = \hat{t}_C^{dCk*drC} * \hat{t}_K^{dcK*drK}$; transmittance of solid colorant cyan+black $t_{MY} = \hat{t}_M^{dMy*drM} * \hat{t}_Y^{dmY*drY}$; transmittance of solid colorant magenta+yellow (red)

$t_{MK} = \hat{t}_M^{dMk*drM} * \hat{t}_K^{dmK*drK}$; transmittance of solid colorant magenta+black $t_{YK} = \hat{t}_Y^{dYk*drY} * \hat{t}_K^{dyK*drK}$; transmittance of solid colorant yellow+black $t_{CMY} = \hat{t}_C^{dCmy*drC} * \hat{t}_M^{dcMy*drM} \hat{t}_Y^{dcmY*drY}$; transmittance of cyan+magenta+yellow $t_{MYK} = \hat{t}_M^{dMyk*drM} * \hat{t}_Y^{dmYk*drY} * \hat{t}_K^{dmyK*drK}$; transmittance of magenta+yellow+black $t_{CYK} = \hat{t}_C^{dCyk*drC} * \hat{t}_Y^{dcYk*drY} * \hat{t}_K^{dcyK*drK}$; transmittance of cyan+yellow+black $t_{CMK} = \hat{t}_C^{dCmk*dr_C} * \hat{t}_M^{dcMk*drY} * \hat{t}_K^{dcmKdrK}$; transmittance of cyan+magenta+black $t_{CMYK} = \hat{t}_C^{dCmyk*drC} * \hat{t}_M^{dcMyk*drM} * \hat{t}_Y^{dcmYk*drY} * \hat{t}_K^{dcmyK*drK}$; transmittance of cyan+magenta+yellow+black $t_{W=1W}$; transmittance of paper white remains the same In the solid colorant transmittances above (Eqs. 10), the superposition dependent initial thicknesses are calibrated during the calibration phase according to equations (8). At printing time, they are therefore known and the only unknowns are the 4 thickness variation factors, the thickness variation factor of cyan $dr_C$, of magenta $dr_M$, of yellow $dr_Y$ and of black $dr_K$. The thickness variation computation model now consists of Eq. (1) in which transmittances $t_1$ to $t_{16}$ are expressed by the 16 transmittances present in Eqs. (10), which in the case of 4 inks, are a function of the 4 thickness variation factors.

The thickness variation computation model has been presented for 4 inks. There is a similar model for 3 inks, for example a model working only with the cyan, magenta and yellow inks. In such a model, the 3 unknown ink thickness variation factors are fitted by minimizing a distance metric such as the square differences between (a) the reflection density spectrum predicted according to Eqs. (1) and (2), but with 8 solid colorants whose transmittances are expressed by Eq. (10) reduced to 3 solid inks (8 solid colorant transmittances) and (b) the measured reflection density spectrum. Since cyan, magenta and yellow inks absorb light in different parts of the wavelength range, very accurate results can be obtained for the cyan, magenta, and yellow ink thickness variations.

The spectral prediction model, enhanced with the ink thickness variation factors, becomes an ink thickness variation computation model. It allows controlling the ink thicknesses of a printing system (a) on specially defined test patches, (b) on freely chosen print image locations and (c) by measuring and predicting the mean reflection spectrum over a stripe within the printed page. Only nominal surface coverages, as defined by the prepress system, need to be known. The ink thickness variation factors can be fitted thanks to the ink thickness variation model once the initial ink thicknesses are fitted and the effective coverage curves have been established (both during calibration). With the effective surface coverage curves, nominal surface coverages of ink are mapped into effective surface coverages of inks, from which the effective surface coverages $a_j$ of the colorants are computed according to the Demichel equations (3) and inserted into Eq. (1). The new ink thickness variation factors, introduced as part of the spectral prediction model are a key element of the present disclosure, see Eqs. (9) and (10).

Calibration of the Ink Thickness Variation Computation Model

Figure 2:
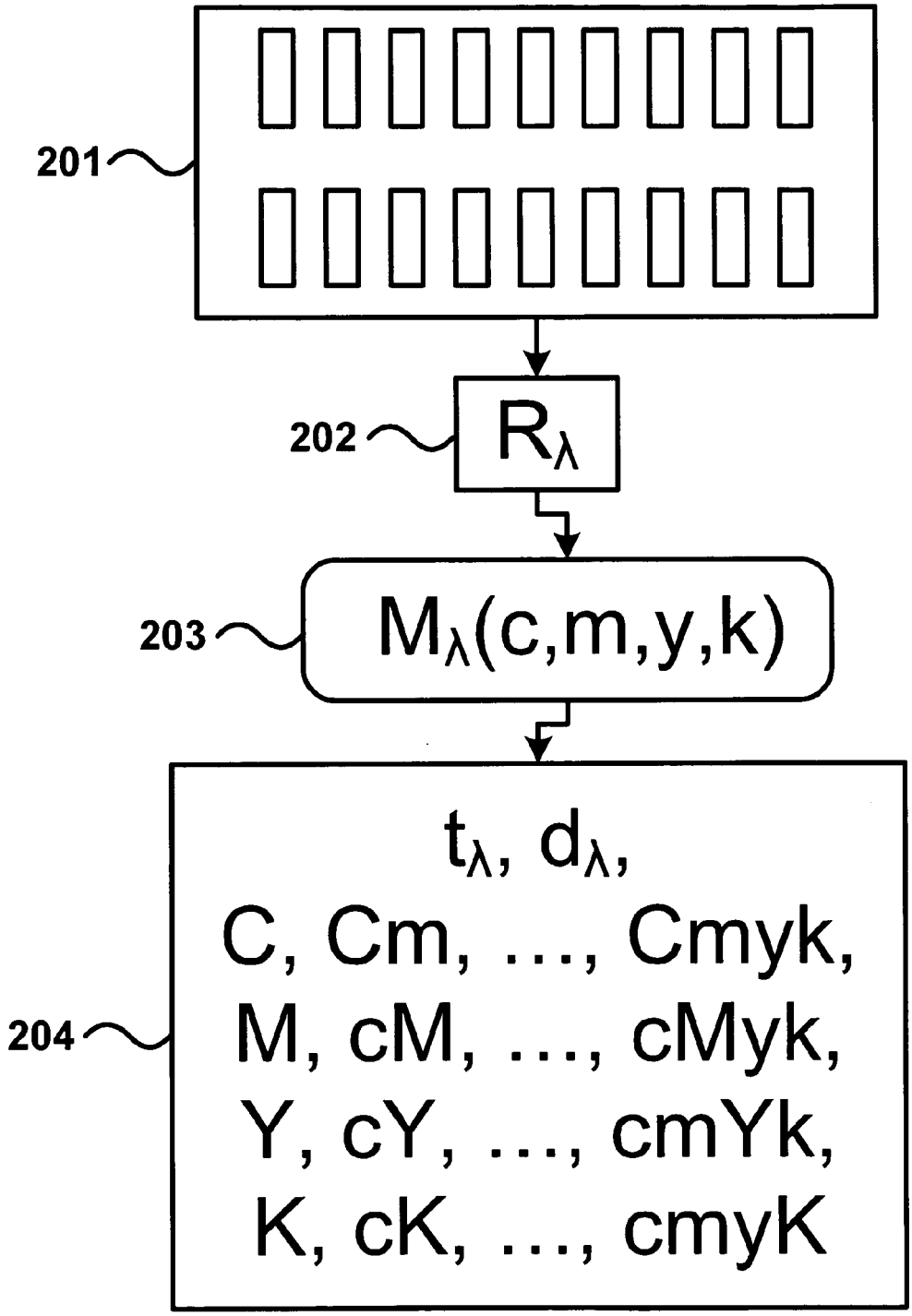
FIG. 2 illustrates schematically the calibration of the parameters of the disclosed ink thickness variation computation model.

The calibration of the ink thickness variation computation model is based on calibration patches 201 printed on a printer, as shown in FIG. 2. A calibration needs to be carried out for each combination of printer, paper and inks. The measured reflection spectra of the calibration patches are used to calibrate the model. The reflection spectra $R_\lambda$ 202 are measured with a photospectrometer. The number of calibration patches depends on the number of inks used in the printer. For two inks, the set of calibration patches consists of 8 patches. For example, in case of cyan and magenta inks, the set of calibration patches comprises paper white, solid cyan, solid magenta, the superposition of solid cyan and solid magenta (colorant cyan+magenta) and four halftone patches: halftone cyan (50% surface coverage), halftone magenta (50% surface coverage), halftone cyan (50% surface coverage) over solid magenta and halftone magenta (50% surface coverage) over solid cyan. For more precision, one may also consider halftones at 25% and at 75% nominal surface coverages. However, in the general case, 50% halftones are sufficient.

The set of calibration patches specified above for two inks can be extended accordingly to three or four inks. The number of calibration patches for a printer with three inks is 8 solid patches+12 halftone patches (3 alone, 3*2 over 1 solid ink, 3 over 2 solid inks)=20 patches and accordingly for a printer equipped with four inks, it is 16 solid patches+32 halftone patches (4 alone, 4*3 over 1 solid ink, 4*3 over two solid inks, 4 over 3 solid inks)=48 patches. The reflection spectra of all calibration patches have to be measured.

The first step of the calibration (204) consists in deducing the transmittances of all the solid colorants i.e. all the possible combinations of single and multiple superposed solid inks. Colorant transmittances may be deduced by the spectral prediction model 203 according to equation (5). Ink transmittances are denoted as $t_\lambda$ in box 204. In a second step of the calibration, the initial ink thicknesses $d_\lambda$ are fitted. The initial thicknesses are either scalar or wavelength-dependent. An initial thickness is calculated for each ink and for each combination of superposed solid inks.

In the third step of the calibration, the effective surface coverage curves are established. An effective surface coverage of a halftone is fitted by minimizing a distance metric between predicted and measured reflection spectra, for example by minimizing the sum of square differences between the predicted reflection density spectra and the measured reflection density spectra. Considered halftones are for example halftones of one ink at 50% nominal coverage, either alone (in box 204: C,M,Y,K) or superposed with one (in box 204: Cm, cM, cY, cK, . . . ) or more solid inks (in box 204: . . . Cmyk, cMyk, cmYk, cmyK, where a capital letter stands for a halftone ink and the lower-case letters for the superposed solid inks). Reflection spectra of single ink halftone patches are measured in all superposition conditions. For all measured halftone reflection spectra, the effective surface coverages are fitted and the effective coverage curves are deduced, e.g. by linear or quadratic interpolation between the fitted effective surface coverages (see also Hersch05A). In a preferred embodiment, 50% surface coverage halftones printed alone and in superposition with one, two and three inks are measured and used to calculate the corresponding effective surface coverage curves. Improved results are obtained when effective surface coverages are fitted with the spectral prediction model with colorant transmittances expressed as in equation a (9) as a function of ink transmittances and initial thicknesses.

Calibration of the ink thickness variation model requires calculating the transmittances, the initial thicknesses and the effective coverage curves shown in box 204. The resulting calibration data (FIG. 3, 304 and FIG. 5, 507) is made accessible to the ink thickness variation computation model for the computation of ink thicknesses.

Ink Thickness Variations Deduced from a Halftone Patch

Figure 3:
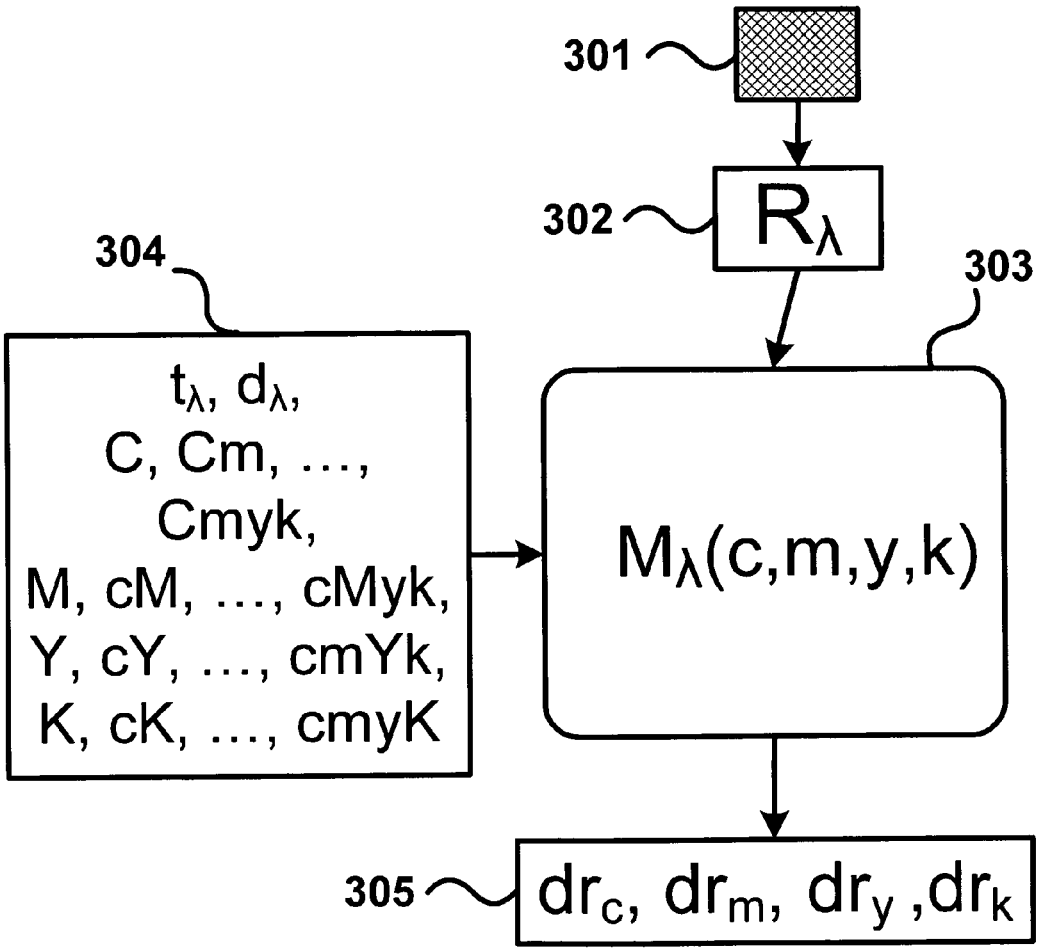
FIG. 3 shows schematically the computation of ink thickness variations from a single polychromatic halftone patch.

FIG. 3 shows schematically how ink thickness variations 305 are deduced from a single polychromatic halftone 301. The halftone may be located at some position within the printed page. Nominal ink surface coverages for this patch have to be known. A reflection spectrum $R_{80}$ 302 is measured with a photospectrometer. The reflection spectrum 302 and the calibration data 304, i.e. transmittances, initial thicknesses and effective surface coverage curves are used by the ink thickness variation computation model $M_\lambda$ (303). The ink thickness variations in box 305 are fitted by minimizing a distance metric between predicted and measured reflection spectra, for example by minimizing the sum of square differences between the predicted reflection density spectrum and the measured reflection density spectrum. In the case of 3 inks which absorb in different parts of the visible wavelength range, accurate thickness variations are obtained. This would also the case for 4 inks if each ink would absorb light in a different part of the visible wavelength range. However, in the case of cyan, magenta, yellow and black inks, the black ink absorbs light in the whole visible wavelength range. The superposition of cyan, magenta and yellow, i.e. the colored black, also absorbs light in the whole visible wavelength range. Therefore, for cyan, magenta, yellow and black inks, in order to create for each ink an independent absorption wavelength range, we extend the range of considered wavelengths from the visible wavelength range (380 nm to 730 nm) to the near-infrared wavelength range (e.g. 740 nm to 950 nm). In the near-infrared wavelength range, the cyan, magenta and yellow colorants do not absorb light. Only the pigmented black ink absorbs light. An ink thickness variation model with a wavelength range from 380 nm to 950 nm, i.e. with the visible and near-infrared wavelength ranges, enables computing thickness variations for the cyan, magenta, yellow and black inks.

Mean Effective Coverage along a Stripe within a Printed Sheet

One of the aims of the present invention is to deduce the ink thickness variations at print time. Since during print the operation, it is difficult and costly to perform a spectral measurement at a specific location of the printed page, we measure a mean spectrum over a vertical (or horizontal) stripe of the print. We consider that the printed areas within the stripe contribute to one "pseudo" halftone which has a reflection spectrum, called mean reflection spectrum, a "pseudo" nominal surface coverage as well as an effective surface coverage called "mean effective surface coverage".

Figure 4:
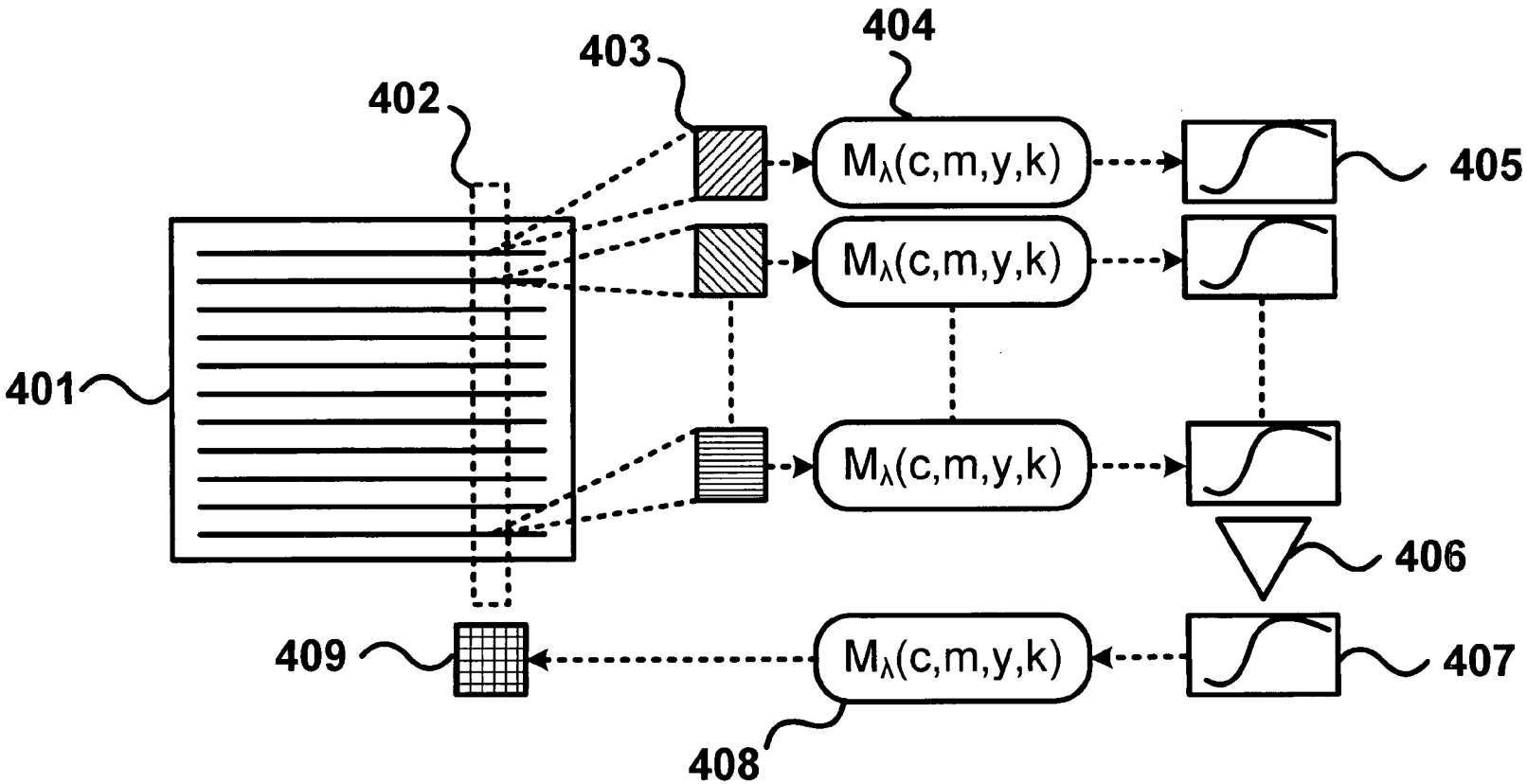
FIG. 4 shows schematically the computation of mean effective surface coverages of a stripe which then allows to predict the stripe reflection spectrum.
Figure 5:
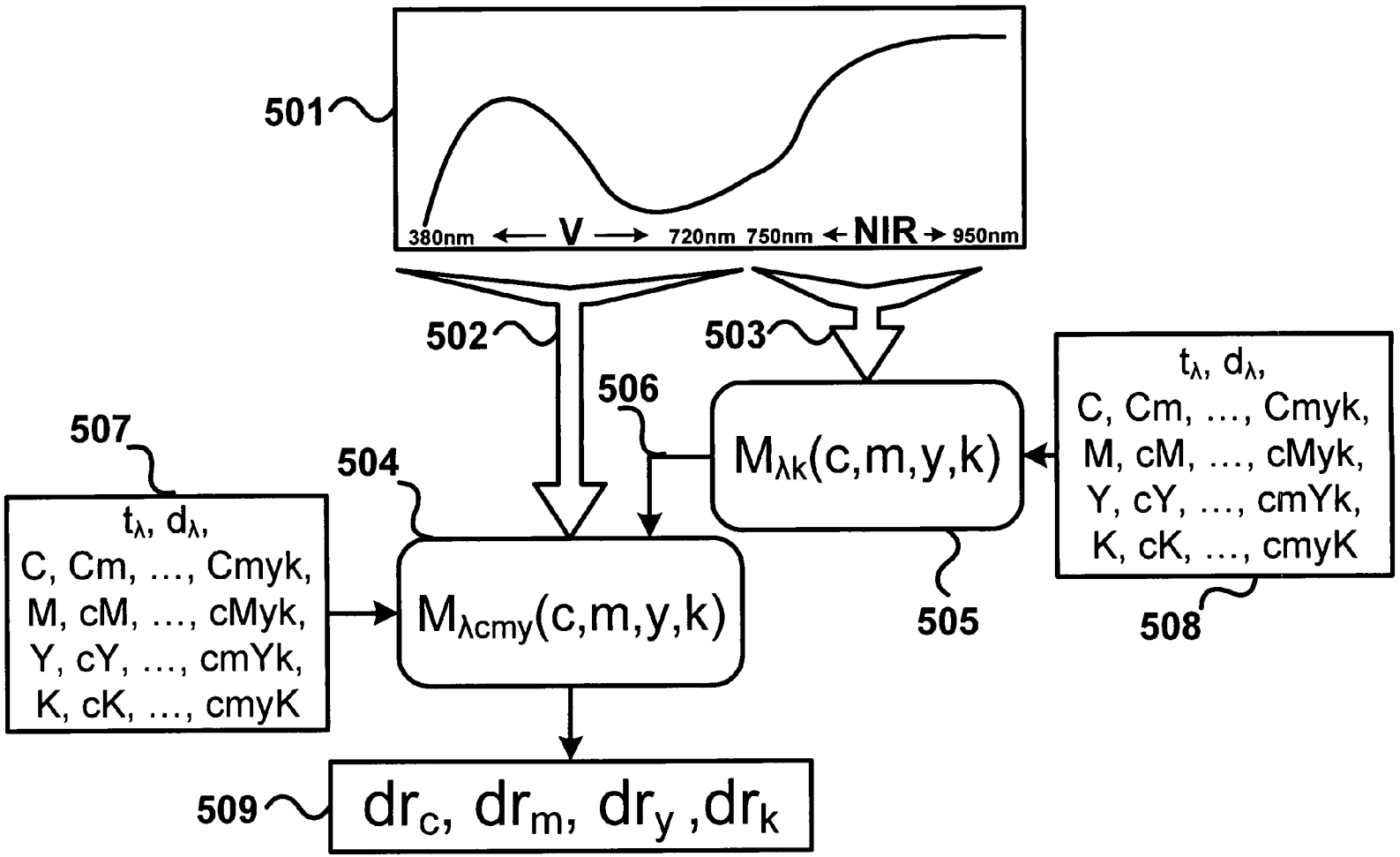
FIG. 5 shows the computation of ink thickness variations in the visible domain and in the near-infrared domain by two instances of the ink thickness variation computation model.

We would like to predict the mean effective surface coverages when there are no thickness variations by making use of the thickness enhanced spectral prediction model [expressed by Eqs. (1) and (7)]. However, since an accurate spectral prediction model (e.g. the Clapper-Yule model) is a non-linear function of the surface coverages, we cannot compute the mean effective surface coverage by simply averaging surface coverages over the stripe area. On the considered printed page (FIG. 4, 401), the stripe area 402 along which the mean spectrum is measured is divided into small areas 403, a small area covering e.g. a single pixel, or an area of e.g. ¼ $mm^2$. We first predict the reflection spectrum of each small area by computing the mean nominal surface coverage over the small area, assuming that, in most cases, the color within the small area is close to uniform, and then, with the thickness enhanced spectral prediction model $M_\lambda$ (404), predict the corresponding small area reflection spectra 405. The predicted mean reflection spectrum 407 of the stripe is the average 406 of all the small area predicted reflection spectra 405 over the stripe area. From the predicted mean spectrum 407, a stripe mean effective surface coverage 409 is computed, again thanks to the thickness enhanced spectral prediction model $M_\lambda$ (408).

Ink thickness variations along the stripe are computed by relying on the stripe mean effective surface coverage in order to predict the stripe reflectance spectrum using the thickness variation enhanced spectral prediction model and by relying on the measured stripe mean reflection spectrum. The ink thickness variations, expressed by the ink thickness variation factors, for the considered stripe are obtained by minimizing a distance metric between the predicted stripe reflection spectrum and the measured stripe mean reflection spectrum, for example by minimizing the sum of square differences between the predicted stripe reflection density spectrum and the measured stripe mean reflection density spectrum.

Deducing Ink Thickness Variations of Black in the Near-Infrared and of Cyan, Magenta and Yellow in the Visible Wavelength Range Domain Since the deduction of ink thickness variations for the cyan, magenta, yellow and black inks within the visible wavelength range is difficult to achieve, we extend the considered reflection spectrum wavelength range to the near-infrared wavelength domain (NIR). We therefore distinguish within the total reflectance spectrum (FIG. 5, 501) the visible wavelength range (V) and the near-infrared wavelength range (NIR). The visible wavelength range (V, e.g. 380 nm to 730 nm) 502 is used for initializing the ink thicknesses and deducing ink thickness variations for cyan, magenta and yellow inks. The near-infrared wavelength range (NIR, e.g. 740 nm to 950 nm) 503 is used for both initializing the ink thickness of black and deducing ink thickness variations for the black ink. Our preferred embodiment consists in creating for each wavelength range a specific instance of the ink thickness variation computation model. For the visible wavelength range and the near-infrared wavelength range, we have two different instances of the thickness variation computation model, respectively $M_{\lambda cmy}$ (504) and $M_{\lambda k}$ (505). After the calibration of each model instance (507 in the visible domain and 508 in the near-infrared domain), we first predict 505 the ink thickness variation of black in the near-infrared wavelength range. This result 506 is used for the thickness variation computation model instance 504 in the visible domain, for predicting the ink thickness variations of the cyan, magenta and yellow inks. The ink thickness variation factor of the black ink is deduced first since the transmittances of the cyan, magenta and yellow inks in the near-infrared domain have a negligible influence on the ink thickness variation of the black ink.

Let us describe in detail how to calibrate the two ink thickness variation computation models, one for the visible domain and one for the near-infrared domain. In a preferred embodiment, the transmission spectra are computed for all the inks both in the near-infrared and the visible wavelength range domains and used in their respective wavelength range domains. Since cyan, magenta and yellow are transparent in the NIR domain, we compute their initial thicknesses and effective surface coverages 507 in the visible domain (V) only and use them in the near-infrared wavelength range model. The initial thicknesses and the effective surface coverage curves 508 of black are computed separately in the two wavelength range domains (V and NIR) and are used in the respective ink thickness variation model instances (V and NIR).

The final result 509 comprises the cyan, magenta and yellow ink thickness variations computed in the visible wavelength range domain and the black ink thickness variation computed in the near infrared wavelength range domain.

Ink Thickness Variation Detection on Printing Presses

In order to cope with the high printing rate of modern printing presses and printers, the disclosed ink thickness variation computing system (FIG. 6, 600) comprises a reflection spectrum acquisition device 602 operable for acquiring a mean reflection spectrum over a stripe of the printed page 601. It also comprises an ink thickness variation computing module 609 or module instances (609 in V and 610 in NIR) operable for computing ink thickness variations 611 by minimizing a distance metric between the reflection spectrum predicted according to a thickness variation enhanced spectral prediction model and the measured reflection spectrum. In the case of a stripe, the predicted reflection spectrum is deduced from the stripe mean effective surface coverages and the measured reflection spectrum is the measured stripe mean reflection spectrum. The disclosed ink thickness variation computing system further comprises a calibration data computing and storing module or computing and storing module instances (605 in V and 606 in NIR) operable for computing and storing calibration data, for deducing ink transmittances from reflection measurements, for computing either wavelength-dependent or wavelength-independent ink thicknesses, and possibly for computing effective surface coverage curves.

During the print operation, the paper 601 moves along the print orientation (e.g. the vertical orientation). The reflection spectrum acquisition device may move over the print cylinder (FIG. 6, 602) perpendicular to the page printing orientation, e.g. in horizontal direction. During spectral data acquisition, the reflection spectrum acquisition device does not move. The paper moves over the cylinder while the data acquisition device sums up reflection spectra, yielding the measured mean reflection spectrum (603 in the visible domain and 604 in the near-infrared domain). An acquisition of one mean reflection spectrum is performed during one full rotation or a plurality of rotations of the cylinder or during a fraction of a cylinder rotation. In the case of a full rotation or more than one full rotation, spectral acquisition can start at any time and needs not be synchronized with the top of the printed page. The nominal ink surface coverages of the corresponding stripe area are obtained from the prepress digital files.

In order to deduce the ink thickness variations at different stripe positions within the printed page, the measuring device moves by a small amount and the ink thickness variations are computed at the new stripe position. This allows computing ink thickness variations at all desired stripe positions within the printed page, for example one stripe along each ink zone of the printing press.

The reflection spectrum acquisition device can be disposed in the vicinity of the print cylinder, e.g. a blanket cylinder of an offset printing press, as mentioned above. However, for measuring the transmittances of dry ink, the reflection spectrum acquisition device is preferably disposed on the pathway of the web several meters, e.g. three to eight meters, behind the cylinder printing last onto the respective web. In a printing press with printing towers in which a plurality of printing units is disposed it is sufficient to provide one reflection spectrum acquisition device for each printing side of the web. Such a printing tower may comprise, in a blanket-to-blanket production, four printing units disposed vertically one above the other each printing unit comprising two blanket cylinders forming one printing nip for printing on both sides of the web. Such a printing tower may comprise, alternatively, two ore more satellite-printing units each unit comprising a plurality of printing cylinders and one central counter pressure cylinder for the plurality of printing cylinders. One or two reflection spectrum acquisition devices per printing tower is or are sufficient if only one web is fed through the tower in one production run. If more production flexibility is required, namely feeding and printing on more than one web in the same printing tower, one reflection spectrum acquisition device for each printing side of each of the webs should be disposed on each pathway on which the webs may be fed out of or after having left the tower. The reflection spectrum acquisition device or devices can be disposed at locations where the web or webs are traveling a free pathway. However, it is preferred that the acquisition device or each of the acquisition devices is disposed in the vicinity of and in direct opposition to a reflection roller over which the respective web is fed.

For a printing press, deduction of ink thickness variations enable automatically regulating the ink flow by acting on the print actuation parameters such as the feed of ink and/or feed of damper agent. The feed of ink can be controlled, in particular, by adjusting a doctor blade, i.e. the width of a narrow gap between an adjustable doctor blade and an inking roller in an inking unit of the press.

Normalized Ink Thickness Variation Computation

In the case of small variations between the calibration conditions (e.g. the ink density during calibration varies slightly from the ink density during normal printing operation) more accurate results may be obtained by computing normalized ink thickness variations.

Normalized ink thickness variation computation requires establishing initial ink thickness variations on a reference print. When printing the reference print, the print densities are observed and verified by a print operator or by another print calibration system (see "Background of the invention"), e.g. by using densitometric measurements and by accordingly acting on the print actuation parameters (e.g. ink feed and/or the damping agent feed). As soon as the current print result meets the desired quality criteria (e.g. densities within a given tolerance range), the ink thickness variations (called "reference ink thickness variations") computed from the stripe reflection spectra at different locations are averaged. The averaged reference ink thickness variations are recorded. From now on, all ink thickness variation computations are normalized in respect to these recorded average reference thickness variations. The ink thickness variation computing system computes the normalized ink thickness variations, i.e., the ink thickness variations in respect to the reference print.

Figure 6:
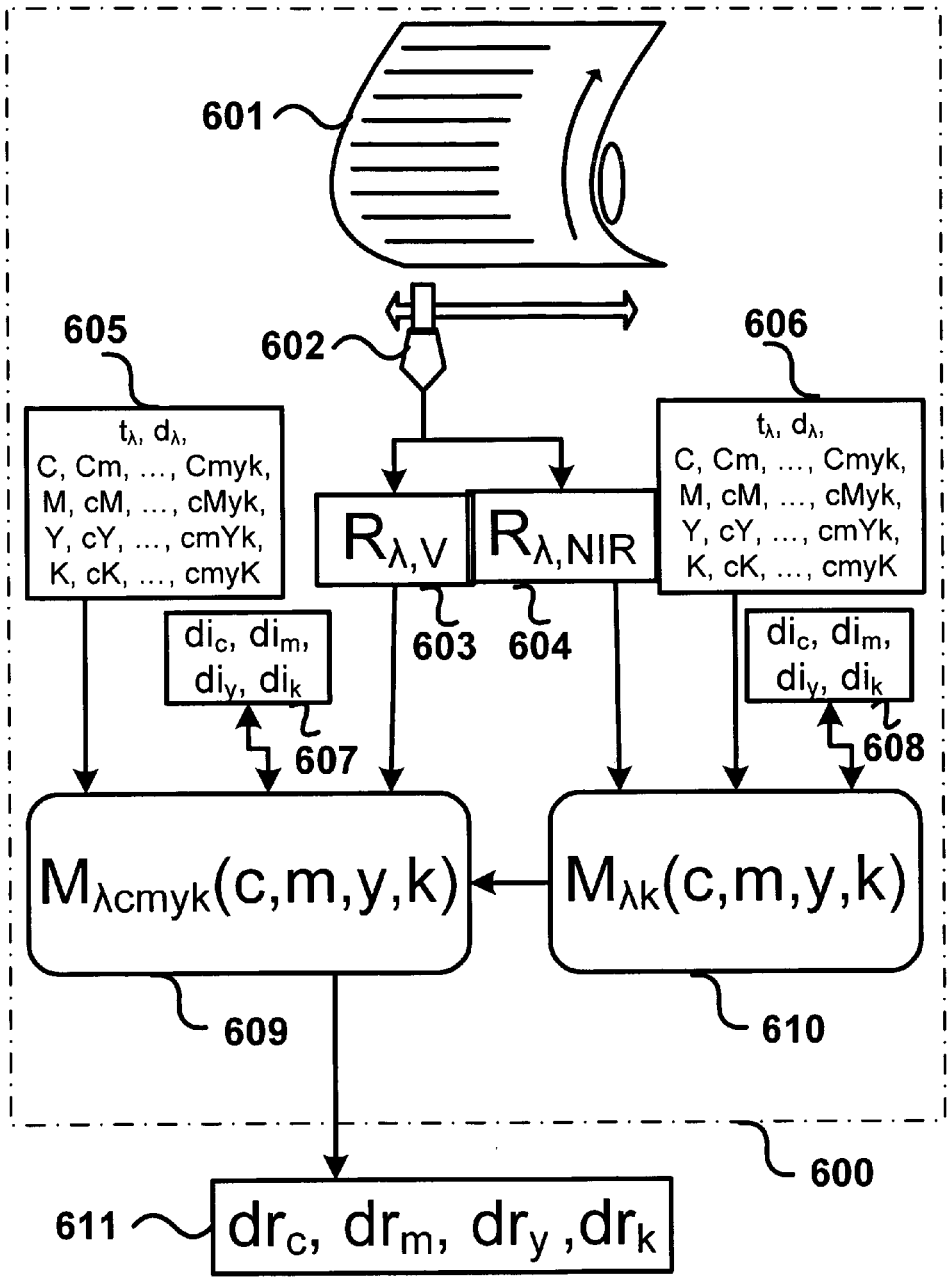
FIG. 6 shows an embodiment of an ink thickness variation computing system.

FIG. 6 shows an example of an ink thickness variation computing system 600 providing normalized ink thickness variations. A mean reflection spectrum is measured 602 on a stripe of a reference sheet 601. The recorded reference ink thickness variations $di_c$, $di_m$, $di_y$, $di_k$ are shown in box 607 (visible domain) and box 608 (near-infrared domain). The ink thickness variations are computed by the ink thickness variation computing modules $M_{\lambda cmy}$ 609 and $M_{\lambda k}$ 610 for all 4 inks, from the measured mean reflection spectra $R_{\lambda,V}$ 603 in the visible wavelength range domain and $R_{\lambda NIR}$ 604 in the near-infrared wavelength range domain, from the stripe mean effective surface coverages and from the initial calibration data 605, 606 comprising transmittances, ink thicknesses and effective surface coverage curves. The computed ink thickness variations are normalized in respect to the recorded reference ink thickness variations in the visible domain 607 and in the near-infrared domain 608. The ink thickness variation computing system 600 yields the computed normalized ink thickness variations 611.

Ink Thickness Variation Computation in Respect to Reference Settings

In a further embodiment, computing the ink thickness variations enables tracking ink thickness variations at print time without knowing the nominal surface coverages of inks, but after having performed a reference setting of the print control parameters of the printing press (e.g. ink feed and/or damper agent feed) by an operator and by another print calibration system. With the reference settings, a reference spectral reflectance is measured from within a reference print page of a print job. Then, ink thickness variations occurring when printing that print job can be deduced by the ink thickness variation computing system.

In the case of document printers hooked onto computer networks, such as ink-jet printers, thermal transfer printers, electro-photographic printers, or liquid toner printers, the correct settings (called "reference settings") of the print actuation parameters are set either by an operator or by another print calibration system, e.g. a calibration system relying on the densities of solid and halftone patches, see Section "Background of the invention". With the reference settings, the reference spectral reflectance is measured within a reference print page, for one or several reference halftones or for a stripe.

The reference effective surface coverages and possibly reference thickness variations are deduced from the reference spectral reflection measurement and recorded. Then, while printing the same print page or after a print session, the same print page is printed again and the corresponding reflection spectrum measured. The ink thickness variation computing system then computes the ink thickness variations occurring in respect to the reference settings. For a printing press, deduction of ink thickness variations enables the automatic regulation of the thickness (or density) of the deposited inks by acting on the print actuation parameters such as the ink feed and/or the damper agent feed. For a printer hooked onto a computer network, deduction of ink thickness variations enables adjusting the printer settings by acting on the print actuation parameters, such as the droplet ejection mechanism in the case of an ink-jet printer, the electronic charge and discharge mechanism as well as possibly the fusing mechanism in the case of an electrographic printer and the head element temperature profiles in the case of thermal transfer or dye sublimation printers.

In the present embodiment, the ink thickness variation computing system does not depend on the knowledge of nominal surface coverages. It depends only on the initial calibration of ink transmittances and solid ink thicknesses and on the measured reflection spectra. Since only the effective surface coverages are used, calibration is simplified by avoiding the need to establish the effective surface coverage curves.

Figure 7:
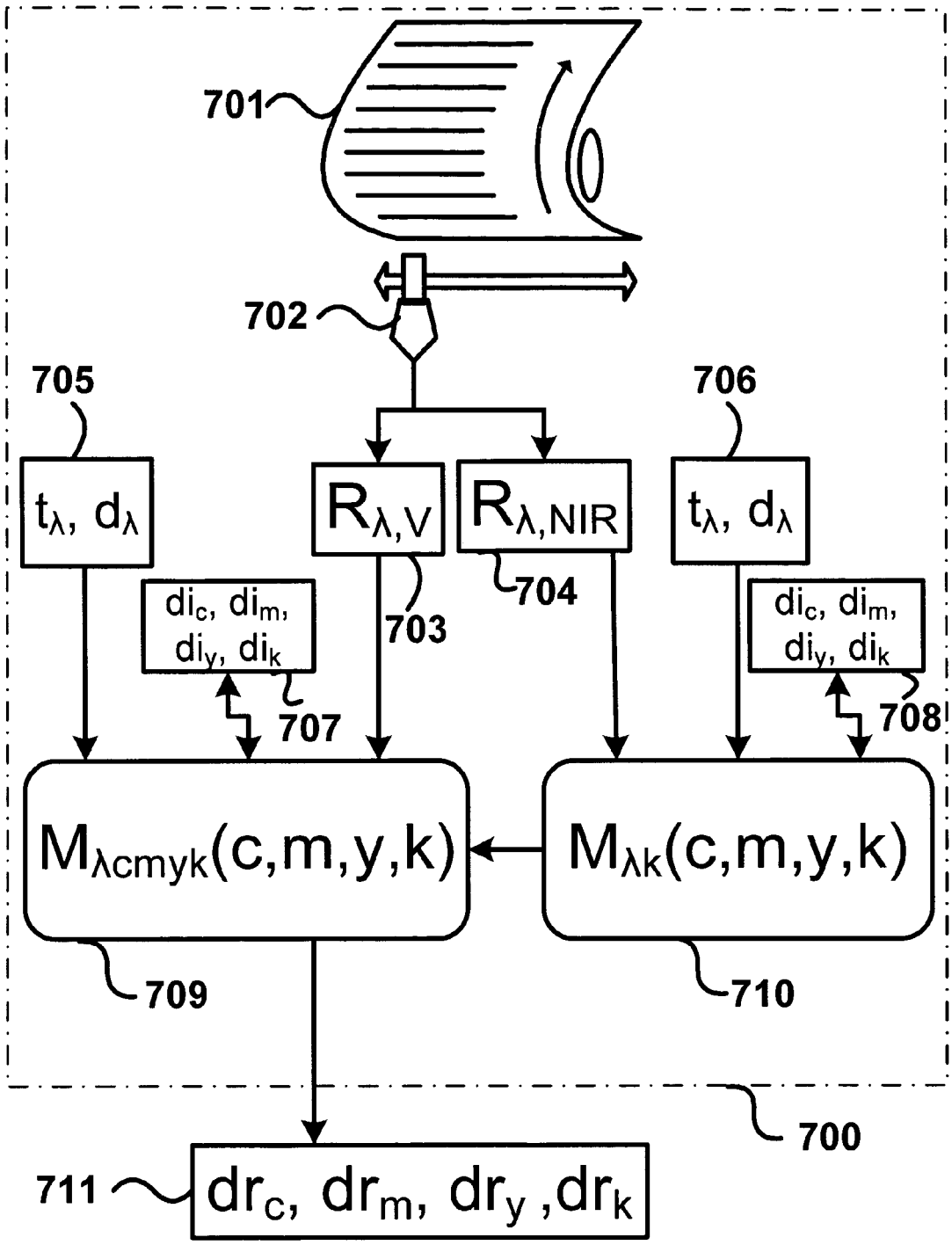
FIG. 7 shows another embodiment of an ink thickness variation computing system which relies on reference settings and on reference spectral reflectance measurements.

FIG. 7 shows an example of an ink thickness variation computing system 700 providing ink thickness variations in respect to reference settings. First, the reference settings are created. Then, reflection spectra are measured 702 on the printed sheet 701 (for example along a stripe) both in the visible domain 703 and in the near-infrared domain 704. The reflectance spectra measured just after having created the reference settings are the reference reflectance spectra. The corresponding reference effective surface coverages are computed and recorded. Then, the ink thickness variation computing system tracks the ink thickness variations, possibly normalized by the reference ink thickness variations (707 in the visible domain, 708 in the near-infrared domain). The ink thickness variation computing system uses as calibration input (705, 706) only the ink transmittances $t_\lambda$ and the initial thicknesses $d_\lambda$ computed during the calibration. Effective surface coverage curves are not needed. If spectral measurements are performed on a stripe, reference mean effective surface coverages are directly computed from the reference measured stripe mean reflection spectrum. There is no need to average the spectral reflectances predicted over the small areas of the stripe and no need to know the nominal surface coverages within the stripe area. The resulting ink thickness variations for cyan, magenta, yellow and black 711 are computed in respect to the reference print page.

Ink Thickness Variation Computation Method

Relying on the ink thickness variation computation model, a method is disclosed for computing ink thickness variations which comprises the step of calibrating a thickness variation enhanced spectral prediction model by (a) deducing spectral ink transmittances from measurements, (b) computing the ink thicknesses of the superposed inks forming a solid colorant and (c) computing the effective coverage curves for halftones in all the superposition conditions. The ink thicknesses may be wavelength-dependent or wavelength-independent. The ink thickness variation computation method further comprises the step of fitting, according to the thickness variation enhanced spectral prediction model, for each contributing ink, the corresponding ink thickness variation factors. This is carried out by minimizing a distance metric such as the sum of square differences between the predicted reflection density spectrum and the measured reflection density spectrum. In the case of cyan, magenta, yellow and black inks, the ink thickness variation method comprises preferably one method variant for the visible wavelength range domain and one method variant for the near-infrared wavelength range domain.

Optionally, if the calibration setup varies from the print setup (slightly different print settings), it is possible to introduce an additional step of computing reference thickness variations for the current print setup and of computing normalized thickness variations at print time.

Thickness variations may be computed for halftone patches, for specific positions within a printed page or for a stripe within a printed page. In the case of a stripe, its mean spectral reflectance is predicted by computing the spectral reflectances of all the small areas of the stripe according to the thickness enhanced spectral prediction model. The predicted mean stripe reflectance is the average of the small area spectral reflectances. The stripe mean effective surface coverages are inferred from the predicted mean stripe reflectance, again, according to the thickness enhanced spectral prediction model.

A further ink thickness variation computation method variant comprises, in addition to the calibration of ink transmittances and ink thicknesses, the step of measuring a reference reflection spectrum, of deducing a corresponding reference effective surface coverage and of computing ink thickness variations by minimizing a distance metric between the reflection spectrum predicted according to the thickness variation enhanced spectral prediction model and the measured reflection spectrum.

A further ink thickness variation computation method variant does not need as calibration data the effective surface coverage curves, but relies on a reference reflection spectrum recorded under reference settings to compute the reference mean effective surface coverages (see section "Ink thickness variation computation in respect to reference settings").

Advantageous Features

Advantageous features are in particular:

1. The concept of a spectral prediction model incorporating explicitly ink thickness variations that are embodied by ink thickness variation factors;
2. The concept of computing wavelength-dependent thicknesses reflecting the fact that inks may partly penetrate into the paper bulk and therefore scatter part of the light;
3. Using a thickness variation enhanced spectral prediction model in order to compute ink thickness variations;
4. The concept of predicting a mean reflection spectrum along a stripe across the printed page by averaging the spectral reflection predictions of all the small areas within the stripe;
5. The concept of deriving mean surface coverages associated to a predicted mean spectrum along a stripe;
6. The concept of computing ink thickness variations by minimizing a distance metric such as the sum of square differences between a predicted stripe reflection spectrum and a measured stripe mean reflection spectrum;
7. Resolving the uncertainty in respect to joint thickness variations in density of cyan, magenta and yellow and a thickness variation of black by extending the ink thickness variations enhanced spectral prediction model to the near-infrared wavelength range.
8. Acquiring a reference reflection spectrum from a position or from a stripe within a reference print page, deriving corresponding reference effective surface coverages and computing for the same print page position or stripe the ink thickness variations by minimizing a distance metric between the reference spectrum predicted according to the reference surface coverages and the currently measured reflection spectrum.

More Detailed Description of the Advantages

The invention has the following main advantages.

1. The ink thickness variations which have been introduced into the spectral prediction model are exactly the variables needed to control the ink deposition process within a printing press or a printer.

2. The effective surface coverage curves expressing the functions mapping nominal surface coverages into effective surface coverages in all the superposition conditions, combined with the spectral prediction model incorporating explicit transmittances for all solid inks and ink superpositions provide accurate spectral reflectance predictions.
3. The wavelength-dependent ink thicknesses accounts for the fact that inks may partly penetrate into the paper bulk. Transmittances of colorants formed by the superposition of at least two solid inks are replaced by solid ink transmittances raised to the power of the respective wavelength-dependent ink thicknesses. Thanks to the wavelength-dependent ink thicknesses, prediction results as accurate as in the case of measured colorant transmittances are achieved by the thickness enhanced spectral prediction model.
4. Fitting ink thickness variations with a distance metric (sum of square differences of density spectra, of exponential spectra, etc . . . ) between the predicted and the measured reflection spectra which gives more weight to the lower reflectances yields more accurate results. This is due to the fact that an ink is characterized by its light absorbing behavior, i.e. the important part of an ink's reflection spectrum is its low reflectance part.
5. For the online real-time computation of ink thickness variations, predicting and measuring mean reflection spectra over a stripe of the printed page enables producing a much cheaper measuring device than the measuring device that would have been designed to measure a single location on a rotating cylinder.
6. The fact that ink thickness variations of the contributing inks can be computed at any print page location or for a stripe enables avoiding printing special patches at the border of the printed page and therefore also avoids the need to cut these special patches out after printing.
7. Resolving the uncertainty in respect to joint thickness variations of cyan, magenta and yellow and a thickness variation of black by applying the ink thickness variation enhanced spectral prediction model not only in the visible wavelength range, but also in the near-infrared wavelength range allows the system to unambiguously compute thickness variations of cyan, magenta, yellow and black, which are the most used inks in printing systems.
8. In case that the calibration conditions deviate slightly from the normal print operating conditions, a recorded set of reference ink thickness variations enables deducing during print operation normalized ink thickness variations with an improved precision.
9. Ink thickness variations may also be computed, when the nominal surface coverages of the target halftone or of the stripe area are unknown, by measuring under optimal settings, for a halftone respectively a stripe area, a reference reflection spectrum, by deriving a corresponding set of reference effective surface coverages and by computing for the same halftone, respectively stripe area for the following printed pages, the ink thickness variations by minimizing a distance metric between the reflectance spectrum predicted according to the reference surface coverages and the currently measured reflection spectrum.

The main advantages mentioned above make the ink thickness prediction computation method and system very useful for print applications where color accuracy is important.

REFERENCES CITED

U.S. Pat. No. 6,230,622 (Image data-oriented printing machine and method of operating the same, to P. Dilling, issued May 15, 2001.

U.S. Pat. No. 4,852,485, Method of operating an autotypical color offset machine, to F. Brunner, issued Aug. 1, 1989.

Patent U.S. Pat. No. 4,685,139, Inspecting device for print, to Masuda et. al, issued Aug. 4, 1987.

U.S. patent application Ser. No. 10/631,743, Prediction model for color separation, calibration and control of printers, to R. D. Hersch, P. Emmel, F. Collaud, filed Aug. 1, 2003, due assignee: Ecole Polytechnique Fédérale de Lausanne (EPFL).

U.S. patent application Ser. No. 10/698,667, Inks Thickness Consistency in Digital Printing Presses, to Staelin et al., filed Oct. 31, 2003.

U.S. patent application Ser. No. 10/186,590, Measurement and regulation of inking in web printing, to Riepenhoff, 1 Jul. 2002, priority 2 Jul. 2001.

F. R. Clapper, J. A. C Yule, "The effect of multiple internal reflections on the densities of halftone prints on paper", Journal of the Optical Society of America, Vol. 43, 1953, 600-603.

R. D. Hersch and al, "Spectral reflection and dot surface prediction models for color halftone prints", R. D. Hersch, et. al., Journal of Electronic Imaging, Vol. 14, No. 3, Aug. 2005, pp. 33001-12, R. D. Hersch, et. al., "Spectral prediction and dot surface estimation models for halftone prints, SPIE Vol. 5293, Jan. 2004, pp. 356-369.

R. D. Hersch and al, "Improving the Yule-Nielsen modified spectral Neugebauer model by dot surface coverages depending on the ink superposition conditions", IS&T/SPIE Electronic Imaging Symposium, Conf. Imaging X: Processing, Hardcopy and Applications, January 05, SPIE Vol. 5667, pp. 434-445.

H. Kipphan, Handbook of Print Media, Springer-Verlag, 2001, pp. 103-105.

G. Rogers, "A Generalized Clapper-Yule Model of Halftone Reflectance", Journal of Color Research and Application, Vol. 25, No. 6, pp. 402-407 (2000).

What is claimed is:

1. A method for computing ink thickness variations for the control of printers or printing presses, the method being based on a thickness variation enhanced spectral prediction model, said method comprising calibration steps and ink thickness variation computation steps, where the calibration steps comprise the calculation of ink transmittances from measured reflectances and the computation of ink thicknesses of solid superposed inks and where the ink thickness variation computation steps comprise fitting of ink thickness variations by minimizing a distance metric between a predicted reflection spectrum and a measured reflection spectrum, where said predicted reflection spectrum is predicted according to the thickness variation enhanced spectral prediction model, where said thickness variation enhanced spectral prediction model comprises for each ink a single ink thickness variation factor, said single ink thickness variation factor being independent of ink superposition conditions.

2. The method of claim 1, where the calibration step also comprises, in order to account for ink spreading, the computation of effective surface coverage of single ink halftones in all superposition conditions and the derivation of effective surface coverage curves mapping nominal to effective surface coverages in all said superposition conditions.

3. The method of claim 1, where the thickness variation enhanced spectral prediction model comprises as solid colorant transmittance of at least two superposed solid inks the transmittance of each of the superposed inks raised to the power of a product of variables, one variable being the superposition condition dependent ink thickness and the other variable being the ink thickness variation factor.

4. The method of claim 3, where the ink thicknesses are wavelength-dependent.

5. The method of claim 1, where the inks are the cyan, magenta, yellow and black inks and where an instance of the thickness variation enhanced spectral prediction model operates in the near-infrared wavelength range domain.

6. The method of claim 5, where the inks are the cyan, magenta, yellow and black inks and where one instance of the thickness variation enhanced spectral prediction model operates in the visible wavelength range domain (V) and a second instance operates in the near-infrared wavelength range domain (NIR), the instance operating in the near-infrared wavelength range domain being used for deducing the thickness variation of the black ink and the instance operating in the visible wavelength range being used for deducing the thickness variations of the cyan, magenta and yellow inks.

7. The method of claim 6, where the ink thicknesses are wavelength-dependent.

8. The method of claim 1, where the measured reflection spectrum is a mean reflection spectrum measured over a stripe of a printed page and where the predicted reflection spectrum is a reflection spectrum predicted from stripe mean effective surface coverages.

9. The method of claim 8, where said stripe mean effective surface coverages are obtained by averaging reflection spectra predicted over small areas composing the stripe and by deducing from the resulting averaged reflection spectrum said stripe mean effective surface coverages and where the ink thicknesses are wavelength-dependent.

10. The method of claim 1, where the ink thickness variation computation steps also comprise the step of recording reference thickness variations and where the computed ink thickness variations are ink thickness variations normalized in respect to the reference ink thickness variations.

11. The method of claim 1, where in addition to the calibration steps, the step of measuring a reference reflection spectrum from a reference print under optimal settings and of deducing corresponding reference effective surface coverages is performed, where the predicted reflection spectrum is predicted with the deduced reference effective surface coverages, and where the computed ink thickness variations represent ink thickness variations in respect to the reference print.

12. An ink thickness variation computing system for the control of printers or printing presses comprising a reflection spectrum acquisition device, a module for computing and storing calibration data and an ink thickness variation computing module, where the module for computing and storing calibration data is operable for deducing ink transmittances from spectral reflectance measurements and operable for computing initial ink thicknesses, where the ink thickness variation computing module is operable for computing ink thickness variations by minimizing a distance metric between a reflection spectrum predicted according to a thickness variation enhanced spectral prediction model and a measured reflection spectrum, and where said thickness variation enhanced spectral prediction model comprises for each ink a single ink thickness variation factor, said single ink thickness variation factor being independent of ink superposition conditions.

13. The ink thickness variation computing system of claim 12, where the ink thicknesses are wavelength-dependent.

14. The ink thickness variation computing system of claim 12, where the inks are the cyan, magenta, yellow and black inks and where an instance of the ink thickness variation computing module operates in the near-infrared wavelength range domain.

15. The ink thickness variation computing system of claim 12, where the inks are the cyan, magenta, yellow and black inks and where one instance of the ink thickness variation computing module operates in the visible wavelength range domain (V) and a second instance operates in the near-infrared wavelength range domain (NIR), the instance operating in the near-infrared wavelength range domain being operable for deducing the thickness variation of the black ink and the instance operating in the visible wavelength range being operable for deducing the thickness variations of the cyan, magenta and yellow inks.

16. The ink thickness variation computing system of claim 12, where the reflection spectrum acquisition device is operable for measuring a mean reflection spectrum over a stripe of a printed page and where the predicted reflection spectrum is a reflection spectrum predicted from stripe mean effective surface coverages.

17. The ink thickness variation computing system of claim 16, where said stripe mean effective surface coverages are obtained by averaging reflection spectra predicted over small areas composing the stripe and by deducing from the resulting averaged reflection spectrum said stripe mean effective surface coverages; and where the ink thicknesses are wavelength-dependent.

18. The ink thickness variation computing system of claim 12, where the ink thickness variation computing module is also operable for recording reference thickness variations and where the computed ink thickness variations are ink thickness variations normalized in respect to the reference ink thickness variations.

19. The ink thickness variation computing system of claim 12, where the ink thickness variation computing module is also operable for recording a reference reflection spectrum from a reference print under optimal settings, for deducing corresponding reference effective surface coverages, and for predicting a reflection spectrum with the deduced reference effective surface coverages, and where the computed ink thickness variations represent ink thickness variations in respect to the reference print.

* * * * *